US009074472B2

(12) United States Patent
Lehnert et al.

(10) Patent No.: US 9,074,472 B2
(45) Date of Patent: Jul. 7, 2015

(54) BIT, IN PARTICULAR A ROUND SHAFT BIT

(75) Inventors: Thomas Lehnert, Oberraden (DE); Heiko Friederichs, Aichhalden (DE)

(73) Assignee: BETEK GmbH & Co. KG (DE)

( * ) Notice: Subject to any disclaimer, the term of this patent is extended or adjusted under 35 U.S.C. 154(b) by 0 days.

(21) Appl. No.: 13/502,376

(22) PCT Filed: Oct. 14, 2010

(86) PCT No.: PCT/EP2010/065446

§ 371 (c)(1),
(2), (4) Date: Jun. 20, 2012

(87) PCT Pub. No.: WO2011/048006

PCT Pub. Date: Apr. 28, 2011

(65) Prior Publication Data

US 2012/0326488 A1 Dec. 27, 2012

(30) Foreign Application Priority Data

Oct. 19, 2009 (DE) ..... 10 2009 049 780

(51) Int. Cl.
*E21C 35/197* (2006.01)
*E21C 35/18* (2006.01)

(52) U.S. Cl.
CPC ..... *E21C 35/197* (2013.01); *E21C 2035/1826* (2013.01)

(58) Field of Classification Search
CPC ..... E21C 35/197; E21C 2035/191
USPC ..... 299/104, 106, 107, 110
See application file for complete search history.

(56) References Cited

U.S. PATENT DOCUMENTS

| | | | | |
|---|---|---|---|---|
| 4,818,027 | A | 4/1989 | Simon | |
| 5,378,050 | A | 1/1995 | Kammerer et al. | |
| 5,683,144 | A | 11/1997 | Kammerer et al. | |
| 5,725,283 | A * | 3/1998 | O'Neill | 299/104 |
| 6,113,195 | A | 9/2000 | Mercier et al. | |
| 6,199,956 | B1 | 3/2001 | Kammerer | |
| 6,378,952 | B1 | 4/2002 | Moosmann et al. | |
| 6,428,111 | B1 | 8/2002 | Kammerer | |
| 6,508,516 | B1 | 1/2003 | Kammerer | |
| 6,619,757 | B1 | 9/2003 | Kammerer | |
| 6,644,755 | B1 | 11/2003 | Kammerer | |
| 6,702,393 | B2 | 3/2004 | Mercier | |
| 6,824,225 | B2 | 11/2004 | Stiffler | |
| D520,035 | S | 5/2006 | Kammerer | |
| 7,195,321 | B1 * | 3/2007 | Sollami | 299/104 |
| D572,735 | S | 7/2008 | Kammerer | |

(Continued)

FOREIGN PATENT DOCUMENTS

| | | | |
|---|---|---|---|
| DE | 3701905 | C1 | 9/1988 |
| DE | 102005042663 | A1 | 3/2006 |

(Continued)

*Primary Examiner* — David Bagnell
*Assistant Examiner* — Michael Goodwin
(74) *Attorney, Agent, or Firm* — Lucian Wayne Beavers; Patterson Intellectual Property Law, PC

(57) ABSTRACT

A bit assembly includes a bit having a bit head and a bit shank, a mounting sleeve being held in the region of the bit shank, and a support element that comprises a guidance region being associated with the bit. To allow the bit to be easily deinstalled from the bit receptacle and allow it, if applicable, to be easily installed again, provision is made that the support element comprises, in the region of its underside facing away from the bit head, a deflection segment.

6 Claims, 3 Drawing Sheets

(56) References Cited

U.S. PATENT DOCUMENTS

| | | | | |
|---|---|---|---|---|
| 7,413,256 | B2 * | 8/2008 | Hall et al. | 299/104 |
| 7,490,912 | B2 | 2/2009 | Holl | |
| 7,922,256 | B2 | 4/2011 | Kammerer et al. | |
| 7,922,257 | B2 | 4/2011 | Kammerer | |
| 8,099,847 | B2 | 1/2012 | Hähn | |
| 2003/0047985 | A1 | 3/2003 | Stiffler | |
| 2003/0137185 | A1 * | 7/2003 | Sollami | 299/106 |
| 2004/0004389 | A1 * | 1/2004 | Latham | 299/104 |
| 2007/0257545 | A1 | 11/2007 | Mouthaan et al. | |
| 2009/0160237 | A1 * | 6/2009 | Kammerer | 299/102 |
| 2010/0181820 | A1 * | 7/2010 | Latham | 299/111 |
| 2010/0295360 | A1 | 11/2010 | Kramer et al. | |
| 2012/0174366 | A1 | 7/2012 | Hähn | |

FOREIGN PATENT DOCUMENTS

| | | | |
|---|---|---|---|
| DE | 102007030640 | B3 | 10/2008 |
| EP | 1427913 | B1 | 2/2006 |
| JP | 2002526702 | A | 8/2002 |
| JP | 2004522022 | A | 7/2004 |
| JP | 2009536701 | A | 10/2009 |
| WO | 03023189 | A1 | 3/2003 |
| WO | WO 2009003561 | A1 * | 1/2009 |
| WO | 2009056227 | A1 | 5/2009 |
| WO | WO 2011016765 | A1 * | 2/2011 |

* cited by examiner

BIT, IN PARTICULAR A ROUND SHAFT BIT

The invention relates to a bit, in particular a round shank bit, having a bit head and a bit shank, a mounting sleeve being held in the region of the bit shank; and having a support element that comprises a guidance region.

A bit of this kind is known from DE 37 01 905 C1. The mounting sleeve is embodied here as a clamping sleeve that is constituted from a resilient material, for example sheet steel. It comprises a longitudinal slot that is delimited by sleeve edges. The mounting sleeve diameter can be varied by means of the longitudinal slot, in which context the sleeve edges are to be moved toward one another (smaller diameter) or spaced farther apart from one another (larger sleeve diameter). Different clamping states can be achieved in this fashion. The support element, embodied as a wear protection disk, is pulled onto the mounting sleeve. This support element has a circular cross section and is penetrated by a bore. The bore is dimensioned such that the mounting sleeve is held, as compared with its slackened state, in a preloaded state having a decreased outside diameter. The outside diameter thereby generated is selected so that the clamping sleeve can be slid with little or no energy expenditure into a bit receptacle of a bit holder. The sliding-in motion is limited by means of the support element. Upon further insertion of the bit shank into the bore, the support element is moved into a region of the bit shank not surrounded by the clamping sleeve. The mounting sleeve then springs open radially and braces itself in the bore of the bit holder. The round shank bit is thereby held in axially captive fashion, but freely rotatably in a circumferential direction. For deinstallation of the bit, it is driven out of the bit receptacle by means of a mandrel acting on the back side of the bit shank.

There are application instances in which the bit can no longer be used for certain milling purposes when it is partly worn away. It is then dismantled, and new unworn bits are installed. The partly worn bits are, however, then still suitable for coarse processing tasks. Because the support element has already been slid away from the mounting sleeve, however, installation then becomes more complicated. Separate clamping tools are used, with which the clamping sleeve can be preloaded in forceps fashion. The bit can then be inserted into the bit receptacle without energy expenditure. The clamping tool is taken off while the bit is in a partly inserted state, and the bit is then driven completely into the bit receptacle with a hammer.

DE 10 2005 042 663 A1 discloses a further bit. A wear protection disk is likewise used here as a support element which holds the mounting sleeve in a preloaded state. The support element can be shifted toward the bit head until the mounting sleeve springs back radially. The support element then engages with protrusions into receptacles of the mounting sleeve, resulting in a non-rotatable bearing point between the mounting sleeve and the support element. Non-rotatable bearing points of this kind have proven to be disadvantageous, since they cause intensified and inhomogeneous wear.

EP 1 427 913 B1 discloses a bit in which a support element can once again be slid off from a mounting sleeve. The support element comes to rest between the bit head and the free end of the mounting sleeve. The support element has, on its side facing toward the mounting sleeve, a peripheral protrusion. The clamping sleeve can become wedged in place on this extension as the bit is driven out, with the result that the clamping sleeve becomes unintentionally spread. Deinstallation then becomes difficult and laborious.

It is an object of the invention to create a bit of the kind mentioned above that enables easy reuse after it is deinstalled from a bit holder.

This object is achieved in that the support element comprises, in the region of its underside facing away from the bit head, a deflection segment.

Upon deinstallation of the bit from the bit receptacle, the mounting sleeve can be brought into effective engagement with the deflection segment. The mounting sleeve is thereby brought into the mounting sleeve segment constituted by the guidance region. The mounting sleeve is then once again in a clamped state that enables facilitated deinstallation of the bit from the bit receptacle. This clamped state then also makes it possible, however, to insert the bit into a bit receptacle, in the context of re-use, with little or no energy expenditure. For initial installation, the bit is preferably already configured in such a way that the guidance region holds the mounting sleeve in a clamped state.

According to an inventive alternative, the mounting sleeve can be moved by means of the deflection segment out of a slackened position into a clamped position. This is advantageous, for example, when the support element has unintentionally been slid away from the mounting sleeve and is in its working position facing toward the bit head. It is then easily possible, by means of the deflection segment, to reestablish an installation position by sliding the support element onto the mounting sleeve. The deflection segment can also serve to bring the mounting sleeve out of a partly clamped position into a clamped position. The partly clamped position exists, for example, when the bit is installed in the bit receptacle and acts with a residual clamping force on the bore wall of the bit receptacle.

To ensure reliable conveyance of the mounting sleeve into the deflection segment, one conceivable inventive variant is such that the support element comprises an introduction region that transitions indirectly or directly into the deflection segment. The mounting sleeve can then, with a segment facing toward the support element, be threaded into the introduction region and brought by way of it into the deflection segment. It has proven to be particularly advantageous in this context if provision is made that the mounting sleeve comprises a guide that is held in the region of the introduction region. A spatial association between the mounting sleeve and the support element is then already arrived at in the installation position. The result of this overlap between the mounting sleeve and support element is to produce a labyrinth-like closure that reduces the risk of dirt penetration. The rotational behavior between the bit and the support element is thereby improved. It is also conceivable for the guide to be at a distance from the introduction region in an axial direction of the bit. The introduction region should then be dimensioned so that the guide of the mounting sleeve can be reliably introduced upon deinstallation. Wear-related deformations of, for example, the mounting sleeve in its region facing toward the support element can, in particular, also be accounted for in this context.

A particularly preferred inventive configuration is such that there is arranged, in the transition region of the bit head into the bit shank, a centering segment that is embodied on its outer circumference in such a way that it forms a rotary bearing point together with the guidance region. The rotary bearing point enables the support element to rotate independently of the mounting sleeve. A wear-optimized design of the bit as a whole is thereby achieved. In addition, this rotary bearing point creates a centered orientation of the bit with respect to the support element, which results in an improvement in the milling result and a decrease in rotational wear.

A bit according to the present invention can be such that the support element comprises on its upper side, facing toward the bit head, an introduction enlargement that transitions indirectly or directly into the guidance region. This introduction enlargement simplifies initial installation of the bit. In this context, firstly the mounting sleeve is placed onto the bit shank; then the support element is slid onto the slackened mounting sleeve, the introduction enlargement serving as a threading-in aid.

A particularly simple design results from the fact that the guidance region and the introduction region are each constituted by a bore; and that the bore constituting the introduction region has a larger diameter than the bore constituting the guidance region.

As already mentioned earlier, an essential structural criterion for bits is a wear-optimized design. The intention is that the least possible wear occur on the cost-intensive bit holder into which the bit is inserted. It is therefore advantageous if the support element exerts as little rotational wear as possible with respect to the bit holder. At the same time, however, the bit should rotate as readily as possible so that it becomes worn away homogeneously over its entire circumference. To ensure this, provision can be made in accordance with a variant design of the invention that the support element comprises, on its upper side, a recess in which a facing region of the bit head is received; and that the bit head is braced with a contact surface on a support surface of the recess. The recess and the facing region of the bit head form a labyrinth-like closure that impedes the penetration of removed material. Good rotatability of the bit with respect to the support element is thereby maintained. It has become apparent that it is disadvantageous if the support element is immobilized nonrotatably with respect to the bit holder, since it can then, as a result of impact loads, work inhomogeneously into the facing contact surface of the bit holder. For this reason, relative movability of the support element with respect to the bit holder needs to be maintained. To ensure this, in accordance with an inventive variant the support element is equipped with recesses on its radially externally located circumferential region. These recesses constitute catch regions for removed material, which then introduces a circumferential force into the support element. It thus induces a rotational motion of the support element. A centered alignment of the support element with respect to the bit holder can be achieved by the fact that the support element comprises a protruding centering projection on its underside. Said projection can engage into a centering receptacle of the bit holder. A kind of seal is once again constituted between the centering projection and centering receptacle, preventing the penetration of removed material. A further wear-optimized bit design is achieved when provision is made that the centering projection comprises a centering surface, extending in inclined fashion with respect to the longitudinal center axis of the bit, that transitions via a setback recess into a circumferential seating surface extending radially with respect to the longitudinal center axis. The setback recess forms a kind of stress-relieving throat. In addition, this recess leaves the associated edge region of the bit holder exposed, resulting in improved free rotatability.

A bit according to the present invention can be characterized in that the mounting sleeve comprises one or more holding elements that engage into a circumferential groove of the bit shank to form a rotary bearing point. This guarantees free rotatability of the bit in a circumferential direction with respect to the mounting sleeve. It is particularly advantageous in this context if provision is made that the holding elements are divided out from the mounting sleeve along two separating edges extending in a circumferential direction; and that the separating edges of the holding elements are located respectively opposite the groove side walls of the groove. The holding elements can be stamped out of the sleeve material, and coordinated with the groove width, in highly dimensionally accurate fashion. A slight axial clearance of the bit shank with respect to the mounting sleeve is left. Depending on the location of the bit, the separating edges constitute linear abutting edges against the facing groove side walls. This configuration enables exact guidance of the bit shank, resulting in improved rotation properties.

The invention will be explained in further detail below with reference to an exemplifying embodiment depicted in the drawings, in which.

Figure 1:
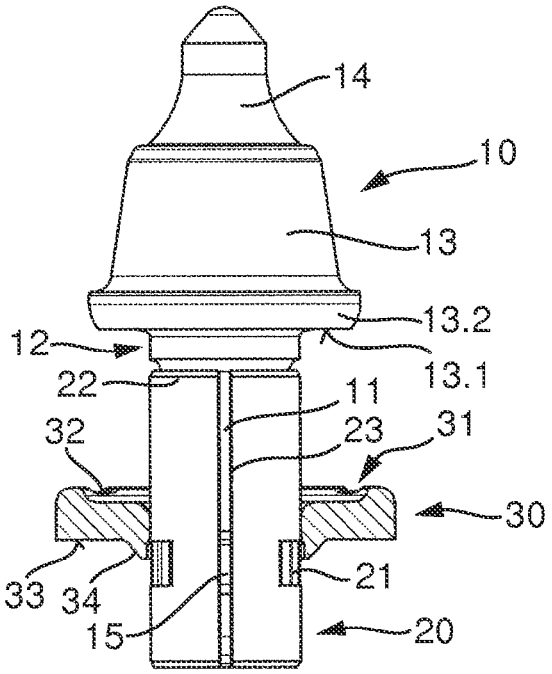
FIG. 1 shows a bit in a prepared initial position.

FIG. 1 shows a bit 10 that is embodied as a round shank bit. It comprises a bit shank 11 that constitutes substantially a cylindrical geometry. A circumferential groove 15 is recessed into the bit shank. Bit shank 11 is attached via a centering segment 12 to a bit head 13. Bit head 13 comprises, at its end facing away from bit shank 11, a bit tip 14 made of hard material, for example hard metal. A cup into which bit tip 14 is soldered is recessed for this purpose into the end of bit head 13. As is evident from FIG. 1, bit head 13 possesses a collar 13.2 in the attachment region to centering segment 12. Collar 13.2 constitutes a downwardly directed contact surface 13.1. Bit 10 is embodied, with its bit shank 11, its bit head 13, and its bit tip 14, rotationally symmetrically with respect to the longitudinal center axis extending through bit tip 14. A mounting sleeve 20 is arranged in the region of bit shank 11. Mounting sleeve 20 is produced from a planar material, for example sheet steel. Holding elements 21 are stamped out of the planar material and pushed out into the region surrounded by mounting sleeve 20. Holding elements 21 are cut out along two stamping edges that extend in a circumferential direction of mounting sleeve 20. Mounting sleeve 20 is rolled up in such a way that a circular cross section results, leaving a clamping slot 23.

A support element 30 is slid onto mounting sleeve 20. Support element 30 is of disk-shaped configuration. The conformation of support element 30 will be explained in further detail below with reference to FIG. 3. As this drawing shows, support element 30 comprises, on its side facing toward the bit head, a cup-shaped recess 31 into which bit head 13 can be set with its collar 13.2. In that context, bit head 13 rests in planar fashion, with its contact surface 13.1, on a facing support surface 31.1 of recess 31. Facing away from recess 31, support element 30 comprises a seating surface 33 that is arranged plane-parallel to support surface 31.1. This seating surface 33 transitions via a recess 35 into a centering step 34. Recess 35 is embodied in this context in the shape of a concave fillet in order to achieve a stress-optimized transition. The centering surface, adjacent to recess 35, of centering projection 34 is arranged in inclined fashion with respect to the longitudinal center axis of bit 10 and, like seating surface 33, extends annularly around the longitudinal center axis of bit 10.

Figure 3:
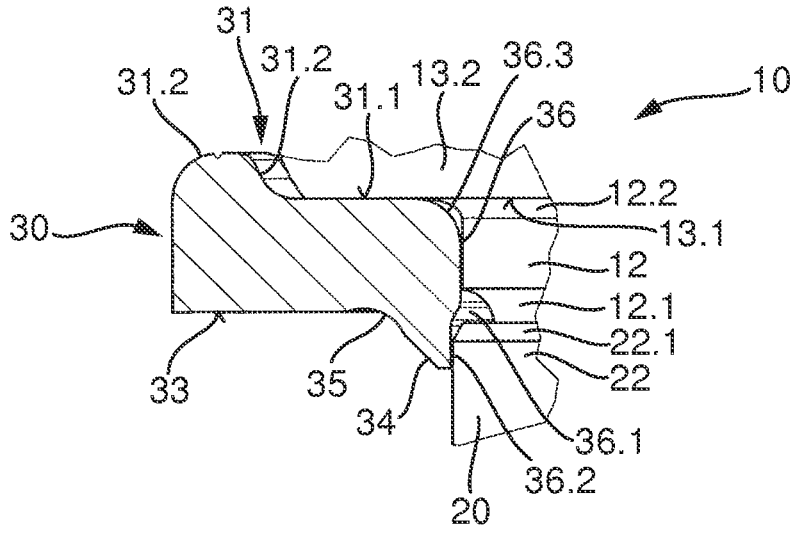
FIG. 3 shows a detail labeled "III" in FIG. 2.

As is further evident from FIG. 3, a bore that constitutes a guidance region 36 is recessed centeredly into support element 30. Guidance region 36 transitions into support surface 31.1 via an introduction enlargement 36.3 developed in rounded fashion. Adjacent to guidance region 36, facing away from introduction enlargement 36.3, is a deflection segment 36.1. Deflection segment 36.1 is constituted by a draft that extends in inclined fashion with respect to the longitudinal center axis of bit 10 and the longitudinal center axis of support element 30. This inclination can be constituted by a linear segment or by a curve segment. An introduction region 36.2 is adjacent to deflection segment 36.1. Introduction region 36.2 is in turn constituted by a bore, the bore diameter being greater than the diameter of the bore generating guidance region 36. Introduction region 36.2 is transitioned into guidance region 36 via deflection segment 36.1.

Figure 2:
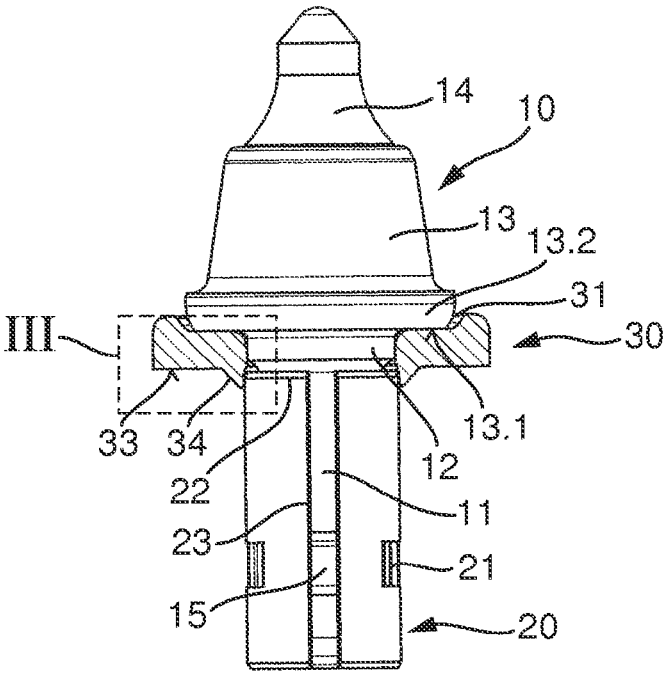
FIG. 2 is a side view of the bit depicted in FIG. 1, in an installation position.

In the installation position, as illustrated in FIGS. 2 and 3, bit head 13 is inserted with its collar 13.2 into recess 31 of support element 30. Centering segment 12 of bit shank 11 is in this context associated with guidance region 36. The result is to create a rotary bearing point between guidance region 36 and centering segment 12. Care must be taken in this context that the outside diameter of the cylindrical centering segment 12 is coordinated with the inside diameter of guidance region 36 in such a way that free rotatability between support element 30 and centering segment 12 is retained. The clearance between these two components should be selected so that the least possible lateral offset (transversely to the longitudinal center axis of the bit (10)) occurs.

FIG. 3 shows that bit shank 11 comprises a fillet region 12.1 that transitions from a reduced-diameter shank region into the enlarged-diameter region of centering segment 12. Mounting sleeve 20 is arranged in the reduced-diameter region. In its end region facing toward support element 30, mounting sleeve 20 constitutes an end-located guide 22. This guide 22 is terminated by a bevel 22.1. In the installation position, guide 22 is arranged in the region of introduction region 36.2. The association is such that a clearance remains between the outer wall of mounting sleeve 20 and introduction region 36.2. This clearance should be selected to be larger than the clearance between centering segment 12 and guidance region 36, thus avoiding contact between mounting sleeve 20 and support element 30 in the installation position. Centering segment 12 and guidance region 36 then therefore take over clearly defined rotational mounting.

Figure 4:
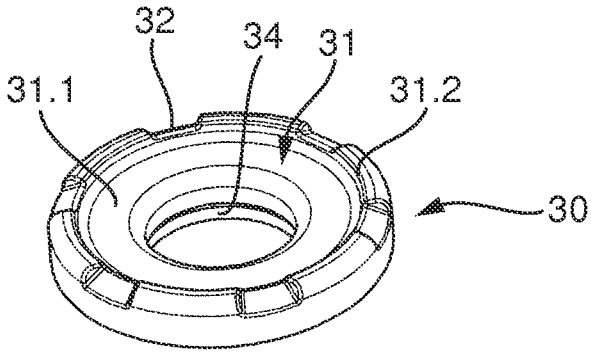
FIG. 4 is a perspective view of a support element shown in FIGS. 1 to 3.

FIG. 4 shows support element 30 once again, in isolation. As this depiction illustrates, recess 31 is delimited by a circumferential rim 31.2 into which recesses 32 are set. Recesses 32 are embodied as radially extending grooves. The depiction in FIG. 4 also makes it apparent that support element 30 is embodied rotationally symmetrically with respect to its longitudinal center axis.

Figure 5:
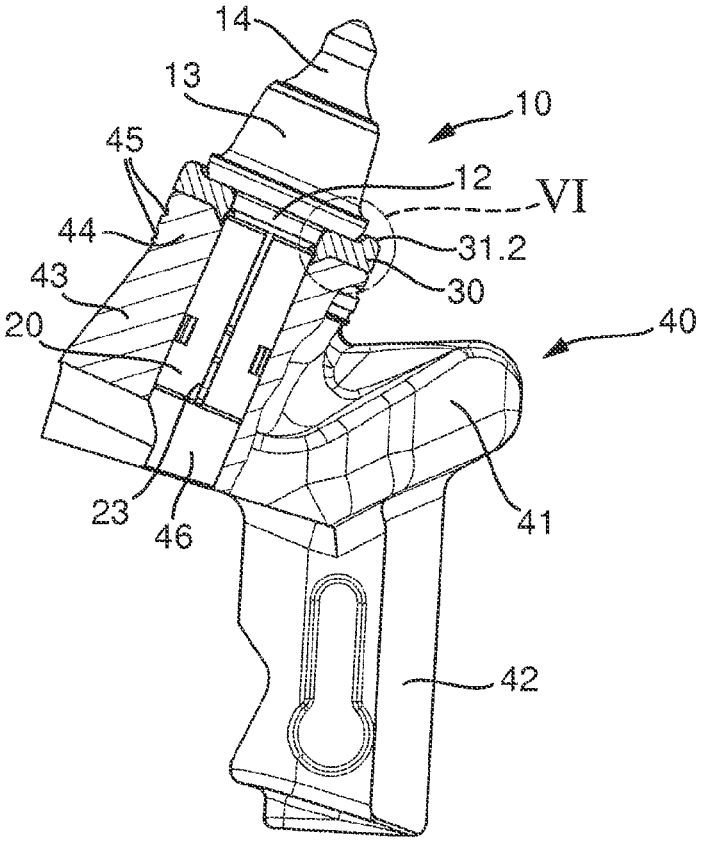
FIG. 5 is a side view of the bit shown in FIGS. 1 to 3, in its installation position on a bit holder.
Figure 6:
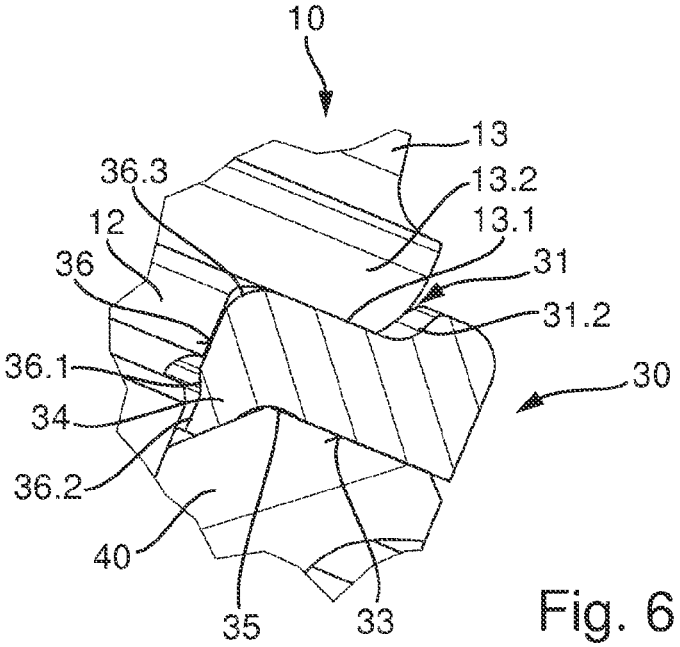
FIG. 6 shows a detail labeled "VI" in FIG. 5.

FIGS. 5 and 6 depict the association of bit 10 with a bit holder 40. As these drawings illustrate, bit holder 40 comprises a base part 41 onto which is shaped an insertion projection 42 protruding on the underside. Base part 41 furthermore carries a holding projection 43, shaped on integrally, into which a bit receptacle 46 is introduced as a cylindrical bore. Bit receptacle 46 is embodied as a through bore that is open at both of its longitudinal ends. A driving-out mandrel (not depicted) of a driving-out tool can be introduced through that end of bit receptacle 46 which faces toward insertion projection 42. This driving-out tool then acts on the free end of bit shank 11. The end of bit receptacle 46 facing away from insertion projection 42 opens into a cylindrical segment 44 of holding projection 43. This cylindrical segment 44 comprises an annular contact surface onto which seating surface 33 of support element 30 is set. As FIG. 6 clearly illustrates, centering projection 34 of support element 30 is inserted into a correspondingly shaped centering receptacle of bit holder 40.

FIG. 6 further shows that introduction enlargement 36.3 of support element 30 is embodied in such a way that the associated edge region between collar 13.2 and centering segment 12 is left open (throat 12.2), so that good rotatability of bit 10 with respect to support element 30 is retained. It is further evident from FIG. 6 that recess 35 leaves open the associated edge region of bit holder 40, thus guaranteeing that seating surface 33 rests in planar fashion on the associated support surface of bit holder 40.

A deinstallation tool, as already mentioned earlier, can be used to deinstall bit 10 from bit holder 40. This deinstallation tool comprises a supporting segment that is braced at the front side on rim 31.2 of support element 30. A driving-out mandrel of this tool can be moved at the back side through bit receptacle 46 so that it acts on the free end of bit shank 11 and pushes it out of bit receptacle 46. The supporting segment of the driving-out tool holds support element 30 in its position. The result is that guide 22 of mounting sleeve 20 is slid into the region of deflection segment 36.1 of support element 30. Deflection segment 36.1 then clamps the end of mounting sleeve 20 constituted by guide 22 radially inward, achieving a reduction in the diameter of mounting sleeve 20 at least in this region. As a consequence of a further displacement of bit 10, mounting sleeve 20 travels with its enveloping region into guidance region 36 of support element 30. This sliding motion can be continued until, for example, the position of support element 30 achieved in FIG. 1 is produced. Bit 10 can then be lifted out of bit receptacle 46 with little or no energy expenditure. It is then available for re-installation.

The invention claimed is:

1. A bit assembly, comprising:

a bit including a bit head and a bit shank;

a mounting sleeve having a circular cross-section interrupted by a longitudinally extending clamping slot, the clamping slot permitting the mounting sleeve to be radially compressed from a larger diameter relaxed position to a smaller diameter clamped position; and a support element having a guidance bore, the guidance bore being dimensioned such that when the mounting sleeve is received in the guidance bore the mounting sleeve is held by the guidance bore in the smaller diameter clamped position, and the support element further including a tapered deflection bore segment communicated with an end of the guidance bore facing away from the bit head;

wherein the support element is movable axially relative to the bit and the mounting sleeve, between an installation position wherein the mounting sleeve is received in the guidance bore and held in the smaller diameter clamped position, and an installed position wherein the guidance bore is located axially between the bit head and the mounting sleeve and the mounting sleeve is in the larger diameter relaxed position; and wherein when the support element is in the installed position an end of the mounting sleeve faces the tapered deflection bore segment such that the end of the mounting sleeve can engage the tapered deflection bore segment and the mounting sleeve can be compressed into its smaller diameter clamped position when the end of the mounting sleeve is forced through the tapered deflection bore segment into the guidance bore to remove the bit assembly from a bit holder.

2. The bit assembly of claim 1, wherein:

the support element includes an introduction bore located on an opposite side of the tapered deflection bore segment from the guidance bore, the introduction bore having a larger diameter than the guidance bore.

3. The bit assembly of claim 2, wherein:

when the support element is in the installed position, the end of the mounting sleeve is received in the introduction bore.

4. The bit assembly of claim 1, wherein:

the support element includes a recess formed in the support element and facing the bit head, the recess being partially defined by a support surface, and the bit head is partially received in the recess and the bit head includes a contact surface engaging the support surface of the support element when the support element is in the installed position.

5. The bit assembly of claim 1, wherein:

the support element includes a tapered centering projection protruding from a side of the support element opposite the bit head.

6. The bit assembly of claim 5, wherein:

the bit includes a longitudinal center axis;

the support element includes a circumferential lateral surface extending radially with respect to the longitudinal center axis; and the support element includes a set-back recess defined therein and transitioning the tapered center projection into the circumferential lateral surface.

* * * * *